US005406772A

United States Patent [19]

Dinius

[11] Patent Number: 5,406,772

[45] Date of Patent: Apr. 18, 1995

[54] TRANSFER CONVEYOR SYSTEM FOR USE BETWEEN STERILE AND NON-STERILE ENVIRONMENTS

[75] Inventor: Harold B. Dinius, Mooresville, Ind.

[73] Assignee: Eli Lilly and Company, Indianapolis, Ind.

[21] Appl. No.: 188,134

[22] Filed: Jan. 25, 1994

Related U.S. Application Data

[63] Continuation of Ser. No. 929,712, Aug. 12, 1992, abandoned.

[51] Int. Cl.[6] ..... B65B 7/28; B65B 55/02; B65B 57/00

[52] U.S. Cl. ..... 53/67; 53/167; 53/264

[58] Field of Search ..... 198/467.1, 610, 611, 198/950; 53/67, 76, 89, 90, 97, 110, 111 RC, 167, 264, 282, 284.5, 284.6, 319, 329, 330, 425, 426, 510

[56] References Cited

U.S. PATENT DOCUMENTS

| | | | |
|---|---|---|---|
| 3,803 | 4/1974 | Oullette | 53/76 X |
| 2,188,306 | 1/1940 | Murch | 53/426 |
| 3,527,017 | 9/1970 | Taylor et al. | 53/167 X |
| 3,677,167 | 7/1972 | Berg | 53/111 RC |
| 3,783,581 | 1/1974 | Pierce | 53/167 X |
| 4,118,914 | 10/1978 | Shields | 53/282 |
| 4,266,651 | 5/1981 | Strom | 198/611 X |
| 4,290,519 | 9/1981 | Harvey | 198/467.1 |
| 4,527,438 | 7/1985 | Fosslein | 198/467.1 |
| 5,251,423 | 10/1993 | Turtschan | 53/426 |

*Primary Examiner*—Linda B. Johnson
*Attorney, Agent, or Firm*—Woodard, Emhardt, Naughton, Moriarty & McNett

[57] ABSTRACT

A sterile product packaging system includes a bottle filling/stoppering machine housed within a sterile environment and a bottle capping machine housed within a non-sterile environment separated by a partition wall from the sterile room. Each of the filling/stoppering machine and capping machine has a belt conveyor associated therewith for moving bottles to and from the machines, each belt conveyor residing entirely within the respective sterile and non-sterile rooms. A transfer conveyor system is provided to transfer bottles from the filling/stoppering machine belt conveyor, through the opening in the partition wall, to the capping machine belt conveyor. The transfer conveyor system includes a lead screw formed of an elongated shank having a continuous spiral thread along its length. A transfer plate overlaps the ends of the two belt conveyors, and is situated beneath and substantially contiguous with the lead screw. The spiral thread of the lead screw has a bottle-engaging root configured to engage a bottle between the lead screw and a guide bar opposite the lead screw. Bottles are pushed from the filling/stoppering machine conveyor belt onto the transfer plate and conveyed along the length of the lead screw as the spiral thread rotates to exit the lead screw onto the capping machine conveyor. The lead screw transfer conveyor system prevents cross-contamination between the sterile and non-sterile environment.

9 Claims, 5 Drawing Sheets

TRANSFER CONVEYOR SYSTEM FOR USE BETWEEN STERILE AND NON-STERILE ENVIRONMENTS

This application is a continuation of application Ser. No. 07/929,712, filed Aug. 12, 1992, now abandoned.

BACKGROUND OF THE INVENTION

The present invention concerns a transfer conveyor system for use between a sterile or "clean" room and a relatively non-sterile room in a sterile product packaging system. In one specific aspect, the invention concerns a transfer conveyor system for conveying bottles from a filling/stoppering machine in a sterile room to a capping machine in a non-sterile room, while minimizing the potential for cross contamination caused by the transfer conveyor system.

Most modern packaging systems are mechanized with electrically controlled conveyors used to transfer containers between packaging stations. For example, controlled conveyors transfer containers to a station in which the containers are filled and from there to a separate station in which the containers are closed, after which the container is discharged. Bottle containers are particularly well suited for this mechanized approach to filling and closing. In some industries, it is essential that certain of the packaging operations occur in a sterile or "clean" environment. One such field concerns medicines or drugs which are subject to regulation by the Food and Drug Administration. In this industry, the filling/stoppering operation is typically conducted in a sterile room to avoid contamination of medicine or drug. Other steps of the packaging process, such as closing the container, need not occur in the sterile environment.

Referring now to FIG. 1, a diagramatic view of a sterile product filling and bottle capping system 10 is depicted to illustrate one such typical system in the industry. For such a system 10, an input conveyor 11 continuously provides containers, such as bottles, to a filling/stoppering machine 12. The filling/stoppering machine resides within a sterile room 13. Alternatively, the source of bottles may also reside within the sterile room 13. At the filling/stoppering machine 12, the empty and sterilized bottles are filled with a medicine or drug and then stoppered. The newly filled and stoppered containers are passed by way of a transfer conveyor 14 to a capping machine 15. As illustrated, the capping machine 15 is housed within a relatively non-sterile room. The capping machine 15 engages a closure to the newly filled bottles and passes the final product to a discharge conveyor 17.

In many prior systems, such as the system 10, the transfer conveyor 14 includes a continuous belt-type conveyor that extends between time filling/stoppering machine 12 and the capping machine 15. One significant drawback of using a continuous belt conveyor is that the belt passes from the sterile to time non-sterile environment and then returns to the sterile room, presenting a significant risk of a contaminated belt returning into the sterile room. Thus, the use of a belt conveyor as time transfer conveyor 14 between sterile and non-sterile rooms may substantially defeat the purpose of segregating time two environments.

Another approach in time industry has been to perform all of the packaging operations in a sterile environment. Thus, the filling/stoppering machine and capping machine would both be situated within the sterile room. In this arrangement, only the final product leaves the sterile room, thereby significantly eliminating the risk of contamination of the medicine or drugs contained therein. Although this approach may provide the greatest security against contamination, large sterile environments are difficult and expensive to maintain. Housing all of the packaging machinery in a sterile environment increases the size of the room required to house all the equipment, which likewise increases the requirements for the sterilization system.

What is needed in the industry is a sterile product packaging system which provides time greatest security against contamination of the product, such as medicines or drugs, without incurring the expense of an enlarged clean room. In addition, this system would optimize the requirements of maintaining a sterile room so that only the essential step of filling the container with sterile product and stoppering need be performed in a sterile environment, leaving the remaining steps of the packaging system to be conducted in non-sterile environments.

SUMMARY OF THE INVENTION

The present invention contemplates a sterile product packaging system which includes a filling machine and stoppering machine housed within a sterile environment, and a subsequent machine for sealing the packaging housed within a non-sterile environment. In a preferred embodiment, the packages are bottles, the filling/stoppering machine is used to fill the bottles with sterile medicine or drugs, and the final packaging step is performed at a bottle capping machine. In one important aspect of the invention, a transfer conveyor system is provided between the sterile filling/stoppering machine and the non-sterile capping machine. The transfer conveyor system extends through an opening in a wall dividing the two environments.

In a preferred embodiment of the invention, the transfer conveyor system extends from the sterile room to the non-sterile room and includes a lead screw which is formed of an elongated shank having a continuous spiral thread along its length. The transfer conveyor system also includes a transfer plate which overlaps the ends of a first belt conveyor leaving the filling/stoppering machine in the sterile room and a second belt conveyor entering the capping machine in the non-sterile room. With this arrangement, neither of the belt conveyors extends through the opening in the dividing wall. The transfer conveyor system, and particularly the lead screw transfer plate, provides the only means for transferring bottles between the two environments.

The lead screw, and particularly the spiral thread, provides a bottle-engaging root which is configured to engage a bottle between the lead screw and a guide bar opposite the lead screw. In this manner, bottles are grabbed from the conveyor leaving the filling/stoppering machine and are conveyed along the length of the lead screw as the spiral thread rotates. The bottles then exit the lead screw at its last spiral thread and are picked up by the conveyor which carries the bottles to the capping machine in the non-sterile environment.

One object of the invention is to provide a transfer conveyor system which is readily adapted for use between product packaging machines positioned in sterile and non-sterile environments, respectively. Another important object is to provide such a conveyor system that substantially avoids or minimizes the risk of contamination of the sterile environment.

A further object of the present invention resides in a transfer conveyor system which can be easily mated with control systems used in controlling the container packaging machinery. Other objects and certain benefits of the present invention will become obvious from the following written description and accompanying figures.

DESCRIPTION OF THE PREFERRED EMBODIMENT

Figure 1:
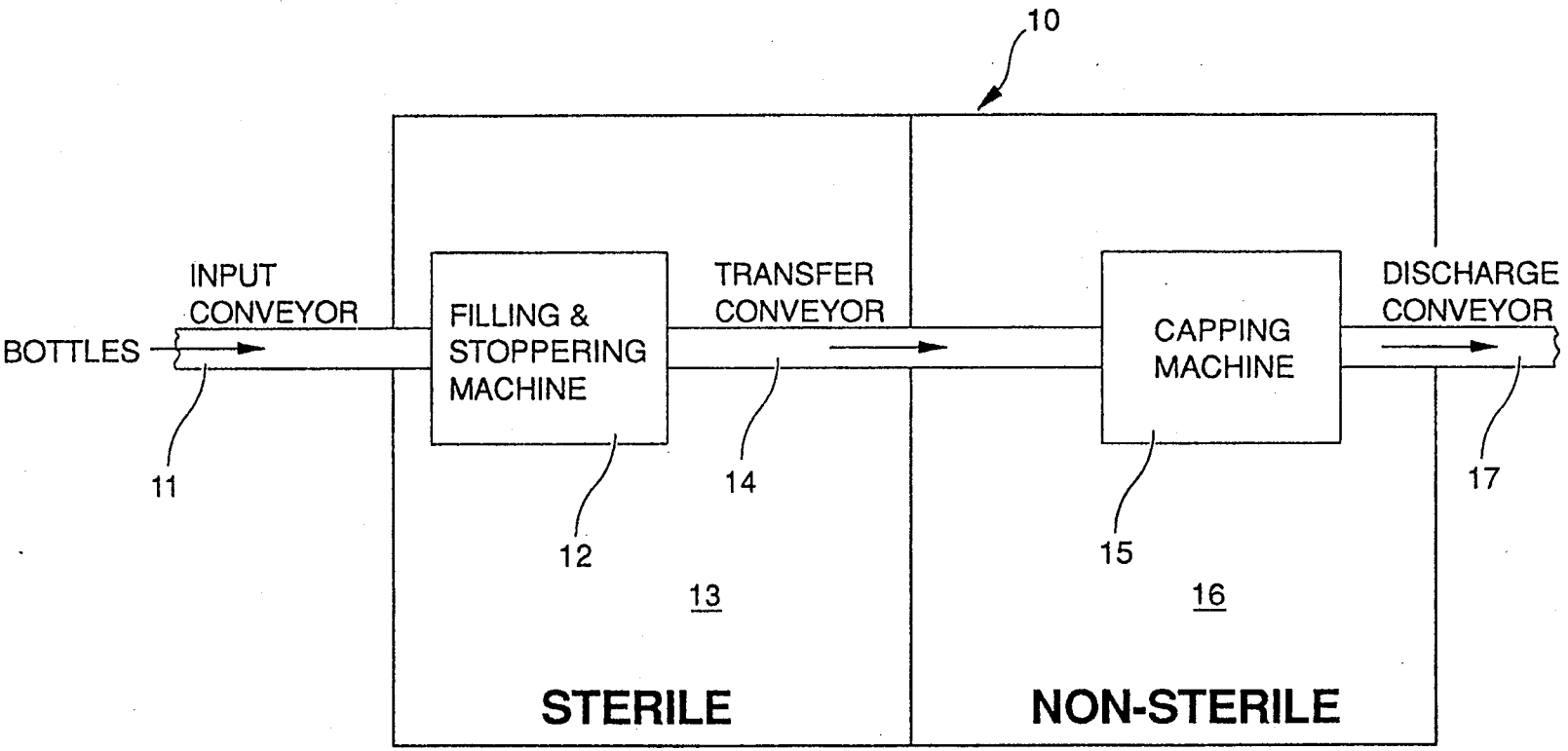
FIG. 1 is a schematic representation of a sterile product packaging system within which the transfer conveyor system of the present invention may be implemented.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring again to FIG. 1, a sterile product packaging system 10 is shown as including a filling/stoppering apparatus 12 in a sterile room 13, and filled and stoppered containers are provided to a closure apparatus 15 in a non-sterile room 16. In one embodiment, the containers are glass vials or bottles, the bottles are filled and stoppered, and the closure apparatus is a bottle capping machine.

Figure 2:
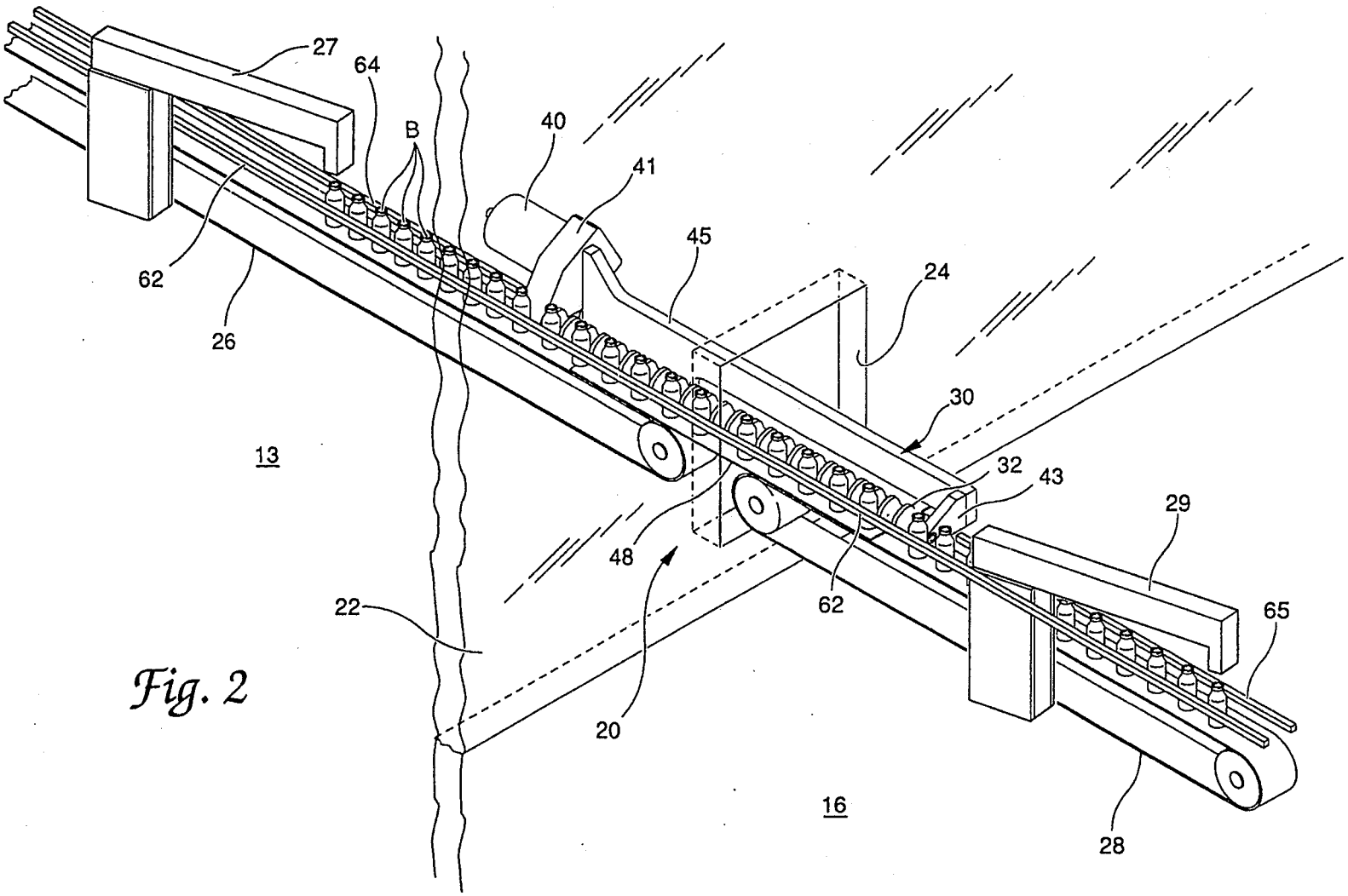
FIG. 2 is a pictorial representation of the transfer conveyor system of the present invention situated between a sterile room and a non-sterile room.

In accordance with the present inventions, the transfer between the filling/stoppering machine 12 and the capping machine 15 is performed by a transfer conveyor system 20 as illustrated in FIG. 2, the transfer conveyor system 20 extends through an opening 24 in partition wall 22 which divides the sterile room 13 and the non-sterile environment 16. Bottles are received by the transfer conveyor system 20 from the filling/stoppering machine by way of a filling/stoppering machine conveyor means 26. Similarly, the transfer conveyor system passes bottles through the opening 24 onto a capping machine conveyor means 28, which then carries the bottles to the capping machine 15.

In the preferred embodiment, as in typical systems in the medicine and drug product industry, both the filling/stoppering machine conveyor means 26 and the capping machine conveyor means 28 comprise a continuous belt-type conveyor. In an important aspect of the invention, neither conveyor means 26 or 28 passes through the opening 24 in the dividing wall 22 so that the belts of the respective conveyor means cannot carry contaminants into the sterile room 13.

In the sterile room, a bottle sensor 27 determines whether a number of bottles B are backed up on the respective filling/stoppering conveyor means 26. Likewise, a similar bottle sensor 29 is provided in the non-sterile room to determine whether bottles are backed up prior to entry into the capping machine 15. Both sensors are used to control the rate and timing of operation of their respective associated conveyor means, or associated filling/stoppering machine 12 and capping machine 15. For example, if the bottle sensor 27 detects a bottle directly underneath the sensor situated on the conveyor means 26, a signal is sent to the filling/stoppering machine 12 to place the machine at idle so that it does not pass further filled bottles onto the conveyor means 26. Likewise, the bottle sensor 29 determines whether the capping machine 15 is having trouble keeping up with the flow of bottles from the filling machine. In this instance, the bottle sensor 29 at the capping machine end of the system will place the capping machine conveyor means 28 in an idle condition until the slowdown at the capping machine has been resolved. In the preferred embodiments, both bottle sensors 27 and 28 are integrated into a complete control system for both the filling/stoppering machine 12 and capping machine 15, as well as the transfer conveyor system 20 itself.

In the preferred embodiment, the transfer conveyor system includes screw conveyor means 30 which extend through the opening 24 between the two conveyor means 26 and 28. In particular, the screw conveyor means 30 overlaps a portion of the outlet or discharge end of the filling/stoppering machine conveyor means 26 and extends through the opening 24 to overlap a portion of the inlet end of the capping machine conveyor means 28. In accordance with the present invention, the screw conveyor means 30 is the only component of the sterile product packaging system that passes between the sterile and non-sterile environments. However, as will become apparent from the following description, no component of the screw conveyor means 30 moves from the non-sterile room to the sterile room, thereby greatly minimizing the risk of contamination of the sterile room 13.

Figure 3:
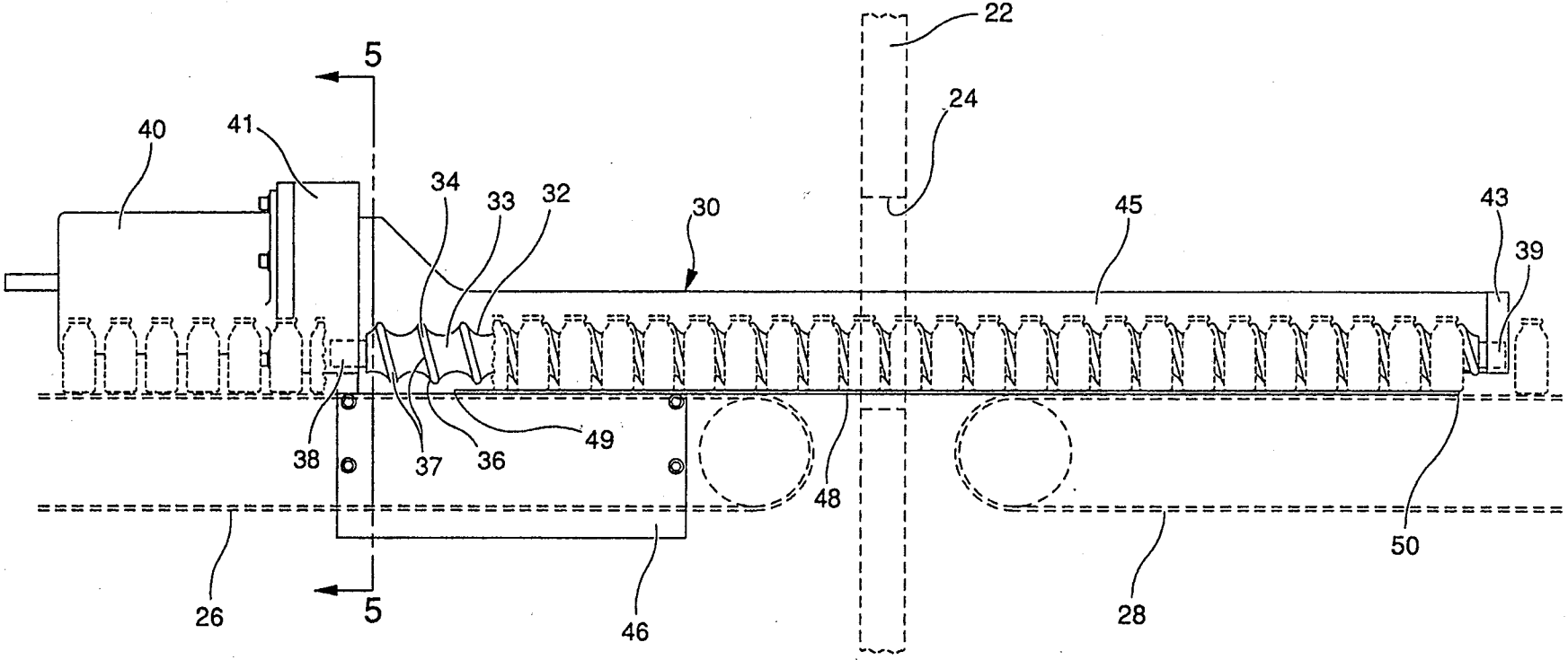
FIG. 3 is a side elevational view of the transfer conveyor system shown in FIG. 2.
Figure 4:
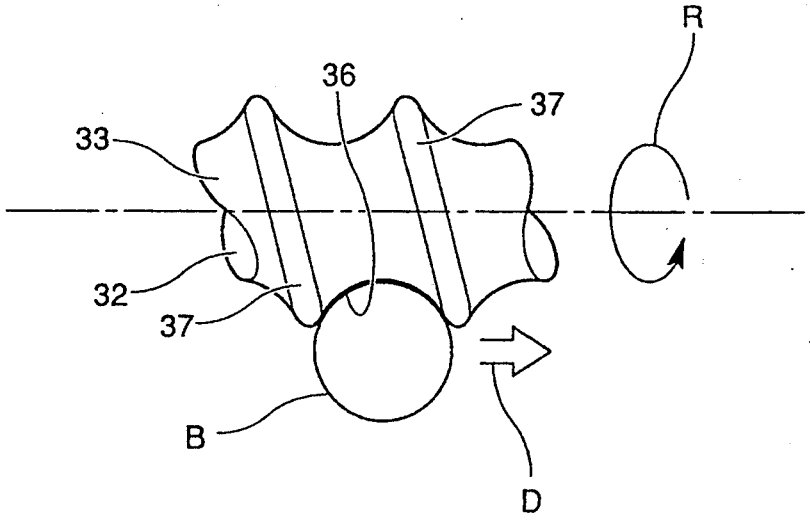
FIG. 4 is a top plan view of a portion of the transfer conveyor system shown in FIG. 3.

The screw conveyor means 30 includes a lead screw 32 as shown in FIGS. 2 and 3. The lead screw 32 comprises an elongated shank 33 onto which a continuous spiral thread 34 is formed. The root 36 of the spiral thread 34 is adapted to engage a bottle between adjacent thread tips 37 at essentially the root diameter of the lead screw 32. The spiral threads 34 of the screw 32 can be formed in the configuration of a typical lead screw or worm-type gear. The manner in which the lead screw 32 engages the bottle B is shown more particularly in the detail view of FIG. 4. In that figure, it can be seen that the bottle B is retained between thread tips 37 in the recessed root 36 of the lead screw. Rotation of the lead screw in the direction of the arrow R causes the spiral threads to push the bottle B in the direction D.

The lead screw 32 includes a drive spindle 38, as shown at the left end of the screw in FIG. 3, and a support spindle 39, at the right end of the lead screw. The drive spindle 38 is connected to a drive motor 40 by way of a gear box 41. The support spindle 39 is rotatably mounted in an end bearing support 43. The lead screw 32 is carried by a frame 45, and more particularly, the gear box 41 and the end bearing support 43 are mounted at opposite ends of the frame 45. A mounting bracket assembly 46 is provided to support the frame on existing structure associated with either the filling machine 12 or capping machine 15. In the preferred embodiment depicted in FIGS. 2 and 3, the mounting bracket assembly 46 is situated in the sterile room and is suitably attached to framework associated with the filling machine in a manner that will be readily known to persons of ordinary skill in this art.

Figure 5:
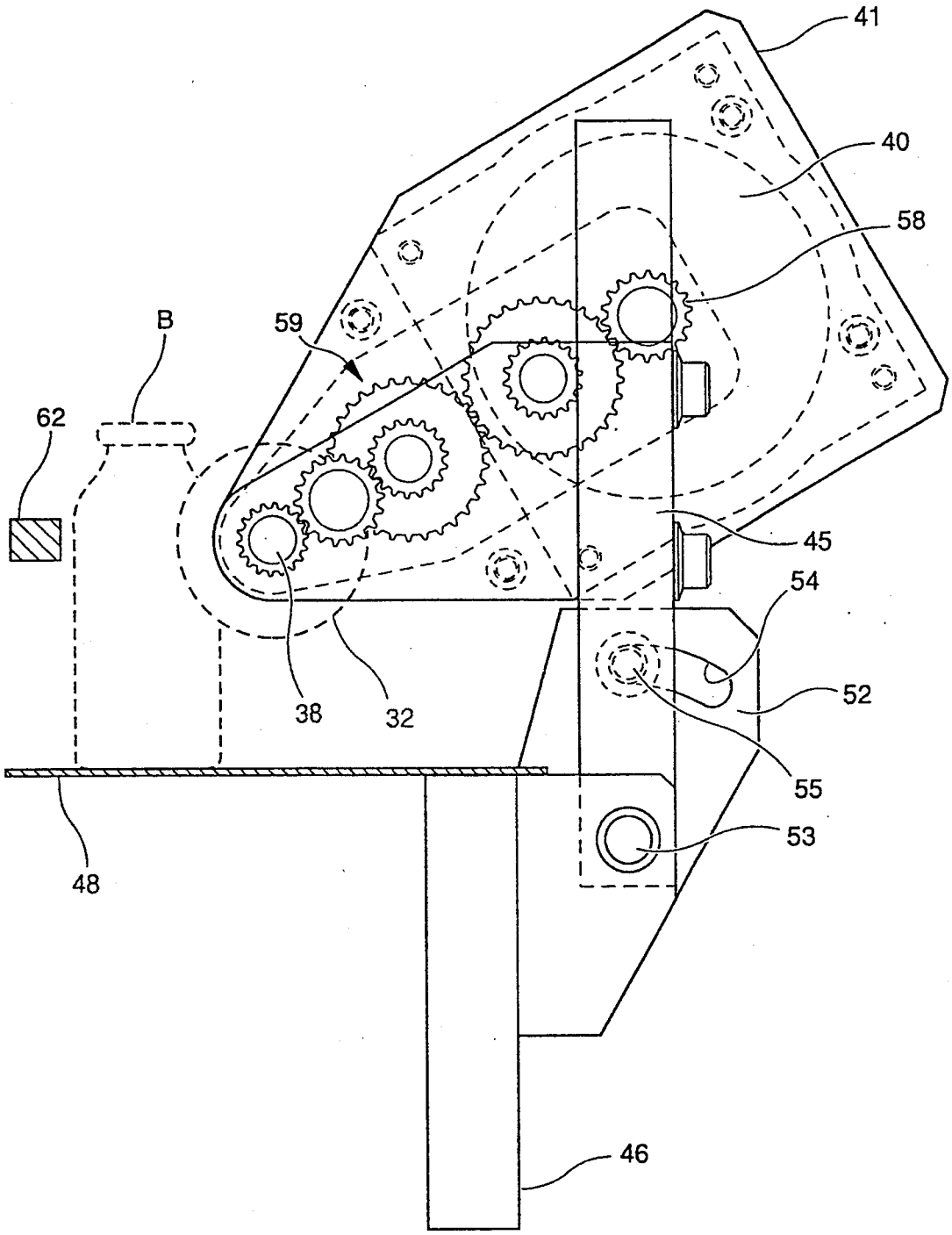
FIG. 5 is a partial cut-away end view of a gear box used to drive the transfer conveyor system shown in FIGS. 2 and 3.

Further details of the transfer conveyor system are shown in FIG. 5. In particular, it can be seen that the system includes a transfer plate 48 supported by the frame 45 and mounting bracket assembly 46, and projects horizontally outward from beneath the lead screw 32 so that the lead screw overlaps a longitudinal edge of the plate. The transfer plate 48 is wide enough to support a bottle thereon when the bottle is disposed between thread tips 37 of the lead screw.

As shown in FIG. 3, the transfer plate resides directly above and in close proximity to the filling machine conveyor belt 26 and the capping machine conveyor belt 28. The plate is generally contiguous with although somewhat shorter than the lead screw, as shown in FIG. 3. More particularly, the transfer plate 48 begins after preferably two windings of the spiral thread 34 on the lead screw 32. By retracting the leading edge of the transfer plate 48 from the end of the lead screw 32, bottles can be engaged by at least one turn of the spiral thread 34 when the bottles are still on the conveyor belt, thereby providing a smooth transfer of the bottles onto the plate 48. Similarly, at the discharge end of the lead screw 32, the transfer plate 48 terminates prior to the end of the lead screw, axed preferably prior to about one turn of the spiral thread 34. In the same manner, the rotation of the lead screw will push bottles off the transfer plate 48 onto the capping machine conveyor means 28 moving beneath time plate.

The transfer plate ,18 preferably includes a leading edge bevel 49 which further facilitates the passage of bottles between the conveyor belt 26 to the transfer plate 48. In addition, a trailing edge bevel 50 may be provided at the opposite end of the plate to provide a smooth transition of bottles from the plate onto the capping conveyor belt moving beneath. As shown in FIGS. 2 axial 3, the transfer plate 48 spans the gap between the ends of the two belt conveyors 26 and 28, extending through the opening 24 in partition wall 22.

Referring back to FIG. 5, it can be seen that the mounting bracket assembly 46 also includes an adjustment plate 52. A pivot mount 53 is provided on the adjustment plate 52 for pivotable attachment of the frame 45 thereto. The adjustment plate 52 includes a guide slot 54 through which a fixation means 55 extends. The fixation means is mounted to the frame 45 and provides means for adjustably fixing the frame to the adjustment plate 52 at the guide slot 54. The mounting bracket assembly 46, and particularly the pivot mount for the frame 45, allows the location of the lead screw 32 to be varied with respect to the transfer plate 48. Thus, the entire transfer conveyor system 20 can be adjusted to account for different sizes of bottles passing between the filling and capping stations. For example, bottles having a larger diameter or a greater height may require that the gearbox 41 and frame 45 be pivoted in the clockwise direction depicted in FIG. 5 in order for the lead screw to engage the bottles without jamming.

The details of the gearbox 41 are shown in FIG. 5. In particular, the motor 40 includes a drive pinion 58 which extends into the gearbox. A cluster gear arrangement 59 is rotated by the drive pinion 58 to ultimately rotate the drive spindle 38 of the lead screw 32. The cluster gear arrangement 59 can be modified as required to provide the optimum gearing between the motor 40 and the lead screw 32. In addition, clockwise or counter-clockwise rotation of lead screw can be accomplished, for example, by modifying the gear arrangement 59 or by reversing the motor.

In a further aspect of the transfer conveyor system 20, a guide bar 62, as shown in FIGS. 2 and 5, is provided opposite the lead screw 32. As shown more specifically in FIG. 5, a bottle B is disposed between the lead screw 32 and the guide bar 62 so that it cannot slip off the plate 48. An upstream guide bar 64 is provided opposite guide bar 62 between the filling machine and the transfer conveyor system 20. Likewise a downstream guide bar 65 is also provided between the conveyor system 20 and the capping machine. The combination of the guide bar 62 with the two upstream and downstream guide bars, 64 and 65, respectively, properly guides the bottles that are traveling on the two conveyor means 26 and 28.

As discussed above, the sterile product packaging system 10 includes a pair of bottle sensors 27 and 29. These bottle sensors control the operation of their respective filling/stoppering machine 12 and capping machine 13. In addition, the transfer conveyor system motor 40 can be controlled by either or both of the sensors 27 and 29. Specifically, if for example sensor 29 detects a backup at the capping machine, a signal can be sent to control both the capping machine conveyor means 28 and the lead screw drive motor 40 to stop or idle these particular conveyor components. Once the backup is resolved at the capping machine, a further signal from the bottle sensor 29 can direct the drive motor 40 for the transfer conveyor system 20 to continue. In a similar manner, the bottle sensor 27 for the filling machine may also control the lead screw drive motor 40.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

For example, the lead screw 32 can be formed of a single molded piece. Alternatively, Lime drive spindle 38 for the lead screw 32 may extend throughout the entire length of the screw suitably fixed in a bore within the shank 33 so that the lead screw rotates with the drive spindle. It is further understood that the drive spindle 38 and support spindle 39 can be mounted within a bearing or bushing arrangement at either end of the lead screw.

The drive motor 40 can be sized according to the speed requirements for the system. Preferably the motor is a variable speed motor which can be electrically tied to the speeds of either or both of the filling machine and capping machine. In one specific embodiment, a COMPUMOTOR* motor, sold by Compumotor Corp, is utilized which is controlled by a sequencing program in an electronic system controller. In this specific embodiment the motor is an electronic stepping motor which is synchronized to a master pulse generated by a shaft encoder on either the capping machine or on the capping machine conveyor.

In another aspect not specifically depicted in the figure, a laminar flow hood can be provided directly above the discharge end of the lead screw 32. This laminar flow hood will provide a further degree of isolation between the sterile and non-sterile environments by drawing air across the conveyor components in a known manner.

What is claimed is:

1. A sterile product packaging system housed within a building, the system comprising:

a sterile room and a relatively non-sterile room in the building;

a first apparatus situated in said sterile room of the building for filling a container under a sterile environment;

a second apparatus situated in said relatively non-sterile room of the building for closing the container in a relatively non-sterile environment;

a wall of the building separating said sterile room and said non-sterile room, said wall having an opening therethrough;

conveyor means for conveying the container from said first apparatus to said second apparatus, said conveyor means including;

first conveyor means for conveying the container from an input portion of said first conveyor means receiving the container from said first apparatus to a distal output portion of said first conveyor mean, said first conveyor means being disposed entirely within said sterile room;

second conveyor means for conveying the container from an input portion of said second conveyor means to a distal output portion of said second conveyor means, said second conveyor means being disposed entirely within said non-sterile room; and screw conveyor means extending through said opening in said wall and between said output portion of said first conveyor means and said input portion of said second conveyor means for transferring the container therebetween, said screw conveyor means including an elongated shank having a spiral thread configured to engage the container therebetween and further including means for rotating said shank, whereby the container is engaged between the thread and is conveyed along a longitudinal length of said shank as the shank is rotated.

2. The sterile product packaging system of claim 1, in which said first apparatus further includes a stoppering apparatus and said second apparatus is a closure apparatus for closing the stopper on the container.

3. The sterile product packaging system of claim 1, wherein said screw conveyor means includes:

an elongated plate having a longitudinal edge extending substantially contiguous with said elongated shank; and means for mounting said elongated plate above and closely adjacent said output portion of said second conveyor means, with said elongated shank overlapping said longitudinal edge, said elongated plate having an input end for receiving the container passing from said first conveyor means onto said plate and a discharge end at which the container passes from said plate onto said second conveyor means.

4. The sterile product packaging system of claim 3, wherein the shank and the spiral thread form a lead screw having a root recess between adjacent thread tips adapted to engage a portion of the container between the adjacent thread tips.

5. The sterile product packaging system of claim 4, wherein said screw conveyor means further includes an elongated guide bar extending substantially contiguous with the shank and means for mounting the guide bar apart from the lead screw at a distance sufficient to allow the container to pass between the guide bar and the lead screw.

6. The sterile product packaging system of claim 3, wherein the elongated plate has a length less than the shank and wherein the plate is supported relative to said screw conveyor means so that a portion of the spiral thread projects beyond the input end and beyond the discharge end of the plate.

7. The sterile product packaging system of claim 3, wherein said screw conveyor means includes means for adjustably positioning the elongated shank with respect to the elongated plate to account for variations in container sizes.

8. The sterile product packaging system of claim 3, wherein the elongated plate includes beveled edges at the input end and the discharge end.

9. The sterile product packaging system of claim 1, and further comprising:

sensor means for detecting a back-up of containers at said second apparatus and for generating a control signal in response thereto; and control means, connected to said means for rotating, for stopping the rotation of said shank in response to said control signal.

* * * * *

UNITED STATES PATENT AND TRADEMARK OFFICE

CERTIFICATE OF CORRECTION

PATENT NO. : 5,406,772

DATED : April 18, 1995

INVENTOR(S) : Harold B. Dinius

It is certified that error appears in the above-indentified patent and that said Letters Patent is hereby corrected as shown below:

In the claims, column 7, line 29, change "mean" to --means--.

Signed and Sealed this

Fifth Day of March, 1996

Bruce Lehman

*Attest:*

BRUCE LEHMAN

*Attesting Officer*

*Commissioner of Patents and Trademarks*